United States Patent [19]

French et al.

[11] Patent Number: 4,778,300

[45] Date of Patent: Oct. 18, 1988

[54] CASE FOR AN APPLICATOR ELEMENT

[75] Inventors: Bruno P. M. French, Neuilly; Gérard J. Joulia, Paris, both of France

[73] Assignee: L'Oreal, Paris, France

[21] Appl. No.: 838,813

[22] Filed: Mar. 11, 1986

[30] Foreign Application Priority Data

Mar. 11, 1985 [FR] France ..... 85 03518

[51] Int. Cl.[4] ..... A45D 40/02

[52] U.S. Cl. ..... 401/55; 401/66; 401/59; 401/99; 401/117; 15/184

[58] Field of Search ..... 401/66, 55, 59, 60, 401/30, 103, 99, 117; 15/184

[56] References Cited

U.S. PATENT DOCUMENTS

| | | | |
|---|---|---|---|
| 544,609 | 8/1895 | Boman | 401/55 |
| 586,254 | 7/1897 | Van Voorhis | 401/30 X |
| 1,913,528 | 6/1933 | White | 401/66 |
| 1,967,301 | 7/1934 | Ferris et al. | 401/59 |
| 2,446,044 | 7/1948 | Davis | 401/103 X |
| 3,338,397 | 8/1967 | Novack et al. | 401/60 |
| 3,728,034 | 4/1973 | Winter | 401/66 X |

FOREIGN PATENT DOCUMENTS

| | | | |
|---|---|---|---|
| 741739 | 2/1933 | France . | |
| 770741 | 9/1934 | France . | |
| 801213 | 7/1936 | France . | |
| 1440990 | 4/1966 | France . | |
| 8198 | of 1904 | United Kingdom . | |
| 418341 | 10/1934 | United Kingdom | 401/59 |

*Primary Examiner*—Steven A. Bratlie

*Attorney, Agent, or Firm*—Cushman, Darby and Cushman

[57] ABSTRACT

An external shell as herein a support for a cosmetic applicator element slidable between a retracted position and an extended position for use of the element. The support is connected to a first rack which extends parallel with the axis of the shell but which is offset in relation to this axis. The first rack meshes with a pinion free for rotation about a pin fixed to the external shell and extending substantially perpedicular to the axis of the shell. The pinion meshes with a second rack parallel to the first but diametrically opposed relative thereto in relation thereto the pin. The second rack is solid with a sleeve which is slidable in the shell and in which the support is slidable. The cosmetic element is, in its retracted position, entirely accommodated within the sleeve and in its position for use, projects at least partially out from the sleeve.

10 Claims, 3 Drawing Sheets

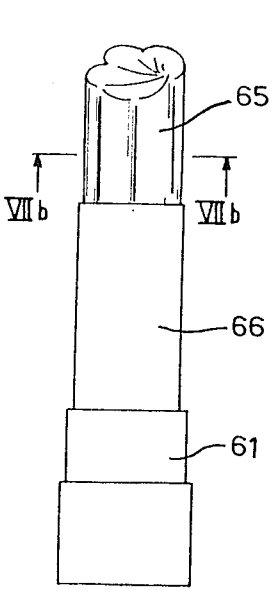
FIG. 3a
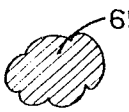
FIG. 3b
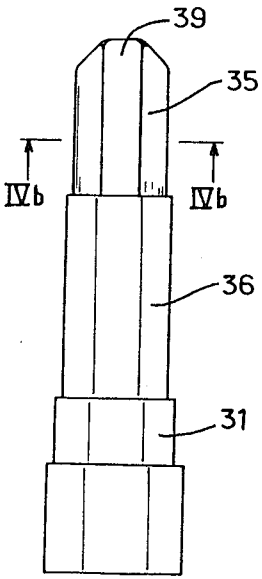
FIG. 4a
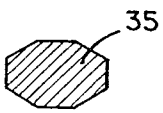
FIG. 4b
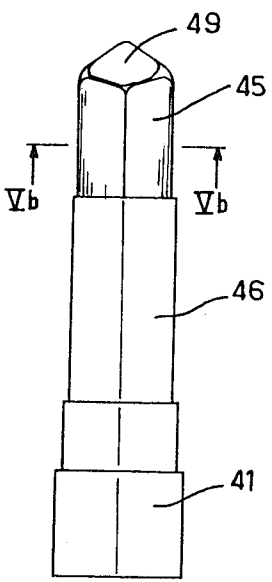
FIG. 5a
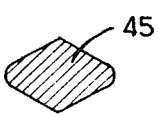
FIG. 5b
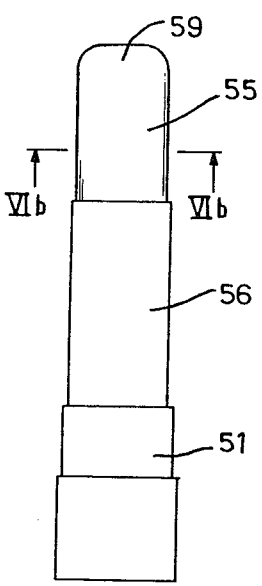
FIG. 6a
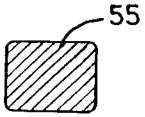
FIG. 6b
FIG. 7a
FIG. 7b

CASE FOR AN APPLICATOR ELEMENT

The present invention relates to a case for an applicator element for a cosmetic product and in particular, for a lipstick or for a brush or pencil brush intended for the application of mascara, this case containing a mechanism with one pinion and two racks for causing the applicator element of the case to emerge, and for retracting it into the case, so that the user can displace the applicator element in relation to the case in order to free either a part of the applicator element from the latter, if this is a lipstick, or the applicator element as a whole, if it is a brush or a pencil brush for the application of mascara, and then to return the applicator element into the case whereon a protective cap is placed to close the case.

From the U.S. Pat. No. 3,338,397, a case of this type is already known containing a lipstick or stick of lip rouge or of another cosmetic product such as a blusher for cheek make-up or eyeshadow; this case comprises:

a cup carrying the lipstick having a tubular part closed by a bottom and wherein a portion of the lipstick is accommodated which is adjacent to its base, a rack parallel to the longitudinal axis of the cup which is eccentric in relation to this axis and integral with the bottom of the cup, a sleeve wherein the cup is axially mounted to slide between two extreme positions whereof one is the retracted position wherein the lipstick is entirely accommodated inside the sleeve and whereof the other is the position for use wherein at least the end of the lipstick on the opposite side to the base projects outside the sleeve.

a tubular base with a closed bottom connected to the sleeve to form the external shell of the case, a pinion meshing with the rack and mounted for rotation around a pin fixed in relation to the base and perpendicular to the longitudinal axis of the cup so that the rotation of the pinion in either direction displaces the rack and therefore the cup towards one or the other of its extreme positions, and a detachable cap telescopically fitted on the sleeve and/or the base so as to close the case when the cup is in the retracted position of the lipstick.

In the embodiment of this type described in this patent, the sleeve is fixed by being fitted on the base to form the external shell of the case and it has a lateral opening through which there comes to project, out of the case shell, a peripheral portion of the pinion which is diametrically opposed to that wherewith the pinion meshes with the rack; this portion of the pinion projecting outside the case is accessible to the user when the protective cap is withdrawn so that the user can actuate the pinion with her thumb and cause it to turn in one or the other direction for actuating the emergence or retraction of the lipstick.

This embodiment has several drawbacks. In particular when the lipstick has been used and its useful length is small, the repetitive manipulations to be effected by the thumb take a long time and are tiresome. Moreover, the possible penetration of foreign bodies into the case between the lateral opening arranged in the sleeve and the pinion, may cause the pinion to become blocked and render the case unfit for use. To restrict these risks, a cap may be used which extends far enough down to the bottom of the base so as to cover the accessible portion of the pinion, but this complicates the making of the cap which must have an internal cut out complementary to the portion of the pinion projecting outside the shell case.

From the French Pat. No. 1 524 774, a case is also known for lipsticks in particular wherein the stick of lip rouge is disposed in the upper compartment of a tubular shell with a closed bottom, divided into two compartments by a partition, the lipstick being pushed step by steep upwards and towards the outside of the shell by repeated actions exerted by the user on a push button; this push button can slide longitudinally by a given step along the external side of the shell and it is connected to a saw-tooth type rack by a leaf spring whose free end cooperates like a pawl with the teeth of the rack; the rack is integral with a sleeve mounted to slide in the lower compartment of the shell.

This embodiment thus makes it possible to extract the lipstick gradually from the case in order to make up for its wear by the operation of the step-wise advance mechanism constituted by the saw-tooth rack, the spring and the push button, but it has the major drawback of not allowing the lipstick to be retracted into the case, which is particularly irksome.

Finally, the French Pat. No. 1 440 990 describes the use for cosmetic packaging of a system comprising two diametrically opposed racks, each meshing with a pinion with a fixed pin held in the outer casing. One of the racks is integral with an applicator device and is pushed by a spring bearing on the external shell of the case. The other rack only performs a pushing function and is operated by the user by means of a container for a beauty product which is introduced inside the case into the rear portion of the latter.

The device in accordance with this French Pat. No. 1 440 990 comprises an external shall which must be able to protect, on the one hand, the applicator element in the retracted position of the latter in the case and on the other hand, protect the pusher rack which, in the emergent position of the applicator element projects on the opposite side to the said element. It follows therefrom that the external shell must extend both towards the front of the mechanism constituted by the racks and the pinion and extend to the rear of the said mechanism. In conclusion, the device proposed in this earlier French Patent has the drawback of being long and bulky.

The present invention allows this drawback to be remedied. For this purpose, in accordance with the invention, the rack controlling the rotation of the pinion is integral with a sleeve protecting the applicator element in the retracted position, the sleeve sliding inside the external shell, the support of the applicator element being capable of sliding in the above mentioned sleeve. It is therefore not necessary for the external shell to have an extension at the rear of the racks/pinion mechanism. Moreover, in accordance with the invention, when the applicator element is being withdrawn from the case, the former is displaced in relation to the sleeve which is subject to a displacement in the opposite direction, whilst in the above mentioned French Patent, the applicator is being displaced in relation to the external shell.

The object of the present invention is therefore a new industrial product constituted by a case for an applicator element comprising an external shell within which a support for the applicator element can be displaced in translation, the said translation causing the applicator element to pass from a retracted position to a position for use or vice versa, the said support being joined to a first rack parallel to the shell axis but offset in relation to this axis, the said first rack meshing with a pinion free for rotation around a pin fixed in relation to the external shell and substantially perpendicular to the axis of the said shell, the said pinion meshing with a second rack which controls its rotation and which is disposed parallel to the first rack whilst being diametrically opposed to the latter in relation to the pinion axis, characterised in that the second rack is integral with a sleeve which slides inside the external shell and wherein the support may slide, the said support thus being displaced towards the position wherein the applicator element is used or retracted when the sleeve is displaced respectively towards the inside or the outside of the shell, the applicator element being in its retracted position entirely accommodated in the sleeve and in its position for use projecting at least partly out of the sleeve.

Preferably, the case comprises a detachable cap being telescopically fitted on the sleeve and/or the shell, the said cap closing the case when the support is in the retracted position of the applicator element.

The applicator element may, in particular, be a brush or a pencil brush and the support is then a stem. The applicator element can be a stick of a product, in particular of lip rouge and the support is then a cup having a tubular section closed by a bottom wherein the portion of the stick is accommodated which is adjacent to its base.

In accordance with a particular embodiment of the present invention, the pinion is constituted by two coaxial wheels placed side by side whereof one cooperates with the first rack and the other with the second, the two wheels having different numbers of teeth. When the wheel with the larger diameter is associated with the rack of the support, the speed of extraction of the applicator element can thus be increased.

Provision can also be made for the sleeve to be integral with two second racks for the support to be integral with two first racks, these first and second racks constituting two pairs of first and second racks facing each other, each pair cooperating with one pinion, the two pinions having parallel axes. In this way, a better mechanical balance of the system is ensured.

In accordance with a particular embodiment of the case, each one of the two axial ends of a pin for rotation of a pinion passes through one of two longitudinal slots arranged in diametrically opposed parts of the portion of the sleeve engaged in the shell and is mounted to turn in the said shell, so that the cooperation of the pin of the pinion and of the slots of the sleeve ensures the axial guidance of the sleeve in its sliding movements in relation to the shell. This embodiment has the additional advantage that it is unnecessary to make provision for a particular member inside the sleeve and the shell for guiding the rack of the support as described in the U.S. Pat. No. 3,338,397, because the sleeve is guided in the shell by the cooperation of the slots of the sleeve and the pin of the pinion, whilst the support with its rack is guided in the sleeve.

Advantageously too, the two racks and the pinion are engaged with sufficient friction for these three components and hence also the support, the sleeve and the shell to remain immovable with respect to each other in all positions assumed by the case within space if no axial force exceeding a certain threshold is exerted on the sleeve. This measure makes it unnecessary to install in the case a locking mechanism within the case accommodated in the shell as provided in the U.S. Pat. No. 3,338,397 so as to immobilise the pinion, and hence the rack of the support and thus also the applicator element, in relation to the shell.

Another advantage of the invention, deriving from the absence of any rotational motion around the longitudinal axis of the case for actuating the movements of the applicator elements, is that the support and/or the sleeve and/or the shell can have transverse sections similar to that of the applicator element when the latter is a stick of a cosmetic product and in particular, oval, polygonal, for instance, rectangular or square, has an diamond shaped or octagonal cross section. A more elegant aesthetic effect can be obtained by giving the stick substantially the form of a fluted cylinder. Moreover, the end of the stick on the opposite side to the base wherewith it bears against the bottom of the cup shaped support, can possibly be dome-shaped, facilitating an accurate application, particularly with lipstick.

In accordance with another characteristic of the present invention, the first rack and the support on the one hand and the second rack and the sleeve on the other hand, are integrally moulded of a plastic substance. This arrangement makes it possible to obtain a case by assembling a very small number of components which all have simple shapes and are moulded of a plastic substance which permits easy and economic mass production.

To render the object of the invention more readily understood, four embodiments represented in the attached drawings will now be described by way of purely illustrative and non-restrictive examples.

FIGS. *3a* to *7a* are lateral elevational views of six variants of the lipstick case in accordance with the above mentioned first embodiment;

The FIGS. *3b* to *7b* are transverse cross sections of the lipstick cases of FIGS. *3a* to *7a* respectively along IIIb—IIIb; IVb—IVb; Vb—Vb, VIb—VIb and VIIb—VIIb.

Figure 9:
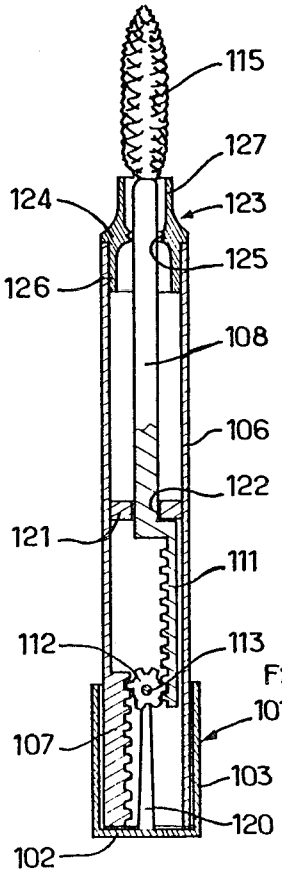
Figure 8:
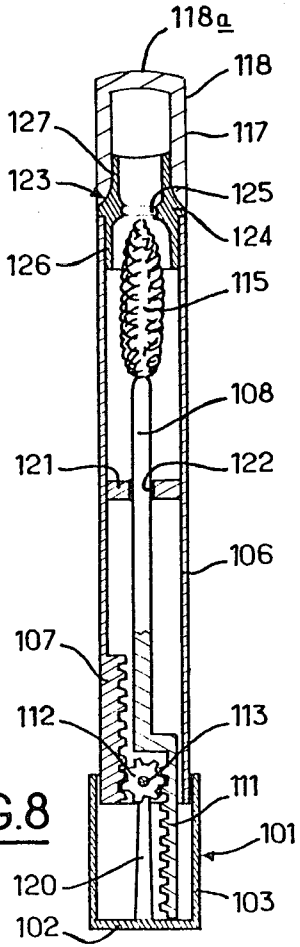

FIGS. 8 and 9 are schematic axial cross sectional views of a device in accordance with a second embodiment of the invention and which is intended for the application of mascara on the eyelids, respectively in the retracted position of the brush, the device being closed by a cap, and in a position where the brush is in use, the cap having been removed.

Figure 1:
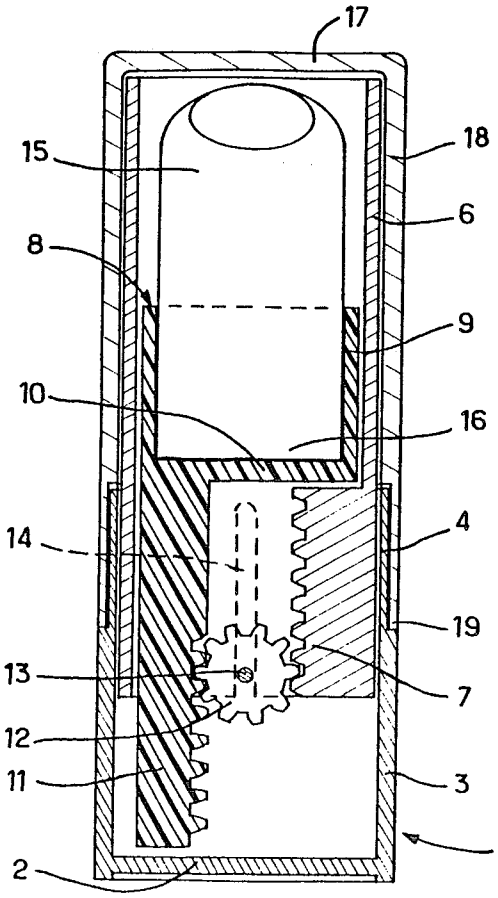
FIG. 1 is a schematic axial cross sectional view of a device in accordance with a first embodiment of the invention, consisting of a lipstick case where the lipstick is in a retracted position, the case being closed by a cap.
Figure 10:
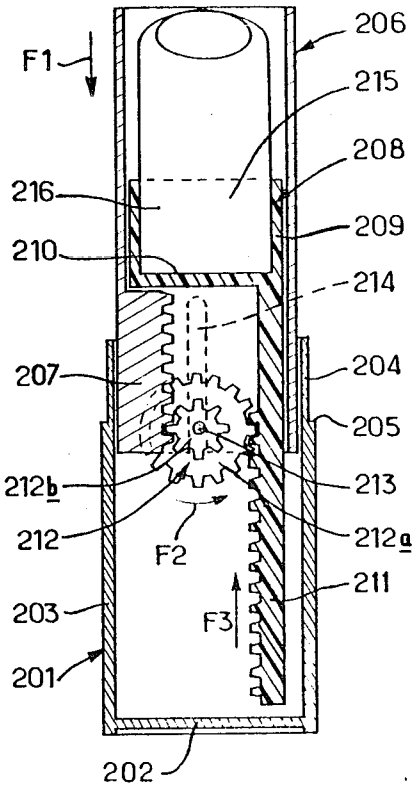
Figure 11:
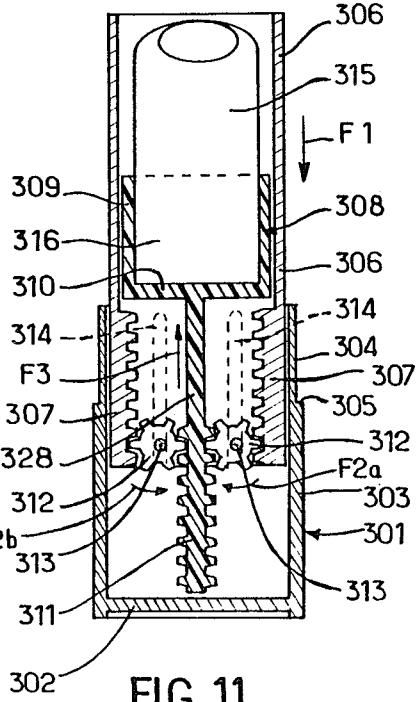

FIGS. 10 and 11 are views similar to FIG. 1 of devices respectively in accordance with third and fourth embodiment of the invention.

Figure 2:
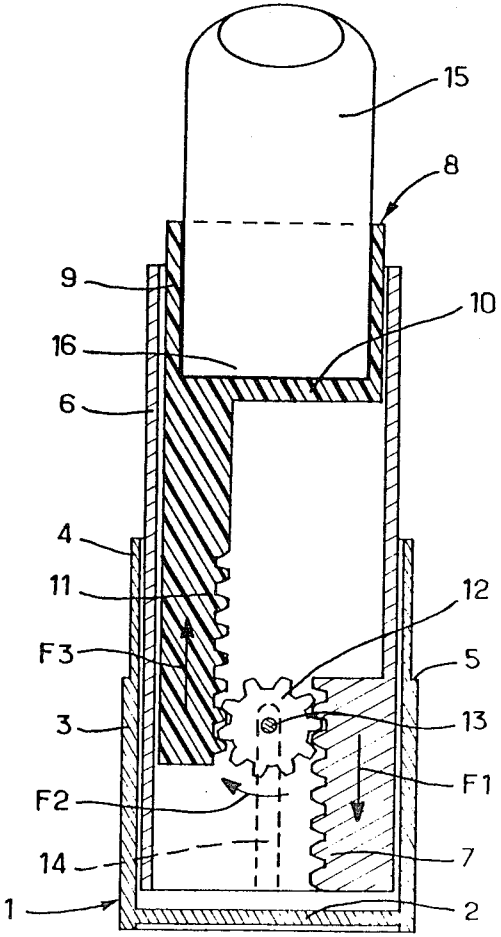
FIG. 2 is a view of the case, similar to FIG. 1, where the lipstick is in a position for use, the cap having been removed.

The lipstick case represented in FIGS. 1 and 2 comprises an outer shell 1 which is cylinder shaped and is closed by a bottom 2 at its lower end. The outer side surface of the shell 1 is sub-divided into a lower portion 3 and an upper portion 4 separated from each other by a radial shoulder 5 (see FIG. 2); the external transverse cross section of the upper portion 4 is thus slightly smaller than that of the lower portion 3, whilst the central duct of shell 1 has a constant transverse cross section. This shell 1 is moulded of a rigid plastic material.

In the shell 1, there is engaged the lower portion of a sleeve 6 coaxial with the said shell 1 and having an external transverse cross section which is slightly smaller than the transverse cross section of the central duct of the shell 1, so that the sleeve 6 can slide axially in the shell 1. On a lower portion of its internal wall, the sleeve 6 carries a rack 7 extending parallel to the longitudinal axis of sleeve 6 whilst being eccentric in relation to this axis and which is integral with the inner wall of the sleeve 6 and integrally moulded of a plastic material.

In the part of the central duct of sleeve 6 which is delimited above rack 7, a cup is slidably mounted constituting the support 8 for an applicator element described below, which is coaxial with the sleeve 6 and constitutes a small cylindrical collar 9 closed by a bottom 10 at its lower end and open at its upper end. The bottom 10 is integral with a rack 11 extending parallel to the axis of support 8 towards the bottom 2 of the shell 1, being eccentric and in the extension of a part of the support 8 which is substantially diametrically opposed to the rack 7 in the sleeve 6. The rack 11 is made integrally with the bottom 10 of the support 8, being moulded from a single piece of plastic material.

Thus the rack 11 is guided against the internal wall of the sleeve 6. The teeth of the two racks 7 and 11 are turned opposite each other and each mesh with one of the diametrically opposed peripheral portions of the teeth of a pinion 12 mounted for rotation around a pin 13 perpendicular to the common axis of shell 1 of the sleeve 6 and of the support 8 and occupying a fixed position in the shell 1. This pin 13 is mounted to turn at each one of its two axial ends in the lower portion 3 of the shell 1 and each axial end of the pin 13 passes through one of the two longitudinal slots 14 arranged in diametrically opposed parts of the lower portions of the sleeve 6.

A lipstick constituting the applicator element 15 is engaged and held at a part adjacent to its base 16 in the collar 9 of the support 8, the base 16 of the lipstick coming to bear against the bottom 10 of the support 8.

In FIG. 1, the case has been represented in the position where the stick 15 is retracted, the portion of the latter projecting beyond the support 8 being entirely accommodated in the upper portion of the sleeve 6, and the lower end of the rack 11 bears against the bottom 2 of the shell 1 or against a stop (not shown) within shell 1, whilst the lower end of the sleeve 6 is separated from the bottom 2 by a maximum distance which corresponds to the position of maximum extension of the sleeve 6 beyond the upper end of the shell 1. In this position, the case can be closed by a detachable protective cap 17 moulded of a plastic material the tubular portion 18 of which, intended to surround the portion of sleeve 6 projecting outside the shell 1, is extended towards the bottom 2 of shell 1 by a thinner skirt 19, by means of which, the cap 17 is telescopically fitted on the upper portion 4 of the shell 1 as far as the radial shoulder 5 of the latter and slides against the external lateral surface of this portion 4 with friction which is adequate for the cap 17 to be held in position on the case when the latter is upended and which is sufficiently low for the cap 17 to be easily withdrawn by an axial pull exerted upwards by the user.

Having removed cap 17, the user exerts an axial force on the accessible portion of the sleeve 6 projecting outside shell 1 which tends to drive the sleeve 6 into the shell 1. The sleeve 6 which is thus axially displaced in the direction of arrow $F_1$ (in FIG. 2) in relation to shell 1, being guided by its longitudinal slots 14 on the ends of pin 13 of the pinion 12, drives by its rack 11 pinion 12 in rotation in the direction of arrow $F_2$ in FIG. 2 (in a clockwise direction). This rotation of pinion 12 produces an axial displacement of the rack 12 and hence of the support 8 and of the applicator element 15 in the direction indicated by arrow $F_3$ which is opposed to the direction of displacement of the sleeve 6 so that the applicator element 15 and the support 8 tend to emerge from the sleeve 6. These opposed axial movements of the sleeve 6 and of the support 8 can be continued until the lower end of the rack 7 comes to bear against the bottom 2 of shell 1 or a separate stop (not shown) in shell 1. The support 8 then occupies such a position that its top edge slightly projects from the upper edge of sleeve 6. The whole portion of stick 15 projecting from the support 8 is thus freed and available for use (see FIG. 2). During these opposing movements, the sleeve 6 is axially guided by the cooperation of its longitudinal slots 14 with the pin 13 and it therefore cannot turn in the shell 1. Thanks to the sizable transverse dimension of the teeth of racks 7 and 11 and of the pinion 12, the meshing of these teeth prevents any rotation of support 8 in the sleeve 6 so that the support 8 cannot turn substantially within the shell 1. The pinion 12 does, moreover, mesh with the two racks 7 and 11 between which it is disposed, with sufficient friction so that the support 8 and its stick of lipstick 15, as well as the sleeve 6, do not change their position relative to each other, nor in relation to to the shell 1 irrespective of the position occupied by the case in space, when the user does not exert an axial force exceeding a predetermined threshold on the sleeve 6. This makes it possible to keep the stick 15 in a position partly emerging from sleeve 6, in particular when the stick 15 is new and has been used but little.

The lipstick cases represented in FIGS. 3*a* to 7*a* are similar to the one which has been described with reference to FIGS. 1 and 2 and they are only distinguished from each other and from that of FIGS. 1 and 2 by the shape of the applicator elements and of the transverse cross sections of the bases, the sleeves and of the supports of the lipsticks.

In FIG. 3*a*, there has been represented a case comprising a lipstick 25 whose transverse cross section has an oval shape, as represented in FIG. 3*b* with a dome shaped upper end with two lateral bevels 29 (of which only one is visible in FIG. 3*a*). The support of stick 25, the sleeve 26 and the shell 21 have transverse cross sections which have oval shapes similar to that of the stick 25.

The lipstick of the case of FIG. 4*a* has an octagonal transverse cross section (see FIG. 4*b*) and its upper end has a frustoconical pyramid shaped dome 39. In this case too, the shapes of the transverse cross sections of the support of the stick 35, of sleeve 36 and of shell 31 are octagonal and similar to that of the stick 35.

The lipstick 45 of the case of FIG. 5*a* has a diamond shaped cross section whose two opposite tips are rounded and the upper end of the stick 45 has a pyramid-shaped dome with rounded lateral bevels 49. The transverse cross sections of the shell 41, the sleeve 46 and of the support of the applicator element 45 also have substantially the shape of diamonds similar to the diamond of FIG. 5*b*.

The case of FIG. 6*a* comprises a lipstick of a rectangular cross section (see FIG. 6*b*) and with a rounded dome shaped upper end 59, and the cross section of sleeve 56 as well as that of the shell 51 is also rectangular.

In FIG. 7*a*, a case is shown whose shell 61 and sleeve 66 have circular cross sections whilst the lipstick 65 has the shape of a fluted cylinder whose cross section is shown in FIG. 7*b*.

It goes without saying that other cross sectional shapes are still possible both for the stick and the shell, the sleeve and the support of the case.

If reference is now made to FIGS. 8 and 9, it will be seen that a mascara applicator device has been shown in these figures comprising, on the one hand, an external shell 101 and on the other hand, a sleeve 106 capable of sliding in the shell 101 and finally a support 108 terminating in an applicator 115 which consists of a brush. The device is capable of being closed by a cap 117.

The external shell 101 obtained by moulding from a rigid plastic material, consists of a tubular element 103 closed at one of its ends by a bottom 102. The height of the element 103 is approximately one and a half times the diameter of bottom 102. The latter carries a stem 120 disposed in the axis of element 103. This stem 120 constitutes the support for a pin 113 disposed perpendicular to the axis of the element 103, substantially in the plane of the free edge of the shell 101. A pinion 112 being constituted by a wheel which is mounted free for rotation around this pin 113.

The sleeve 106, also obtained by moulding from a rigid plastic material consists of an elongated tubular element whose height is approximately four times that of the shell 101. The external diameter of the sleeve 106 is slightly smaller than the internal diameter of the shell 101. The sleeve 106 carries on a lower portion of its internal wall, a rack 107 which is integral therewith. This rack 107 extends from the bottom free edge of sleeve 106 up to a height slightly higher than that of the shell 101 and it is situated parallel to the axis of sleeve 106 but being offset in relation to this axis.

Approximately at its center, the sleeve 106 has an internal ring 121 whose central opening 122 is traversed by the support 108 as will be described below.

At its end opposite to that carrying the rack 107, the sleeve 106 comprises a wiping element 123 for the brush 115 of the mascara applicator. The element 123 consists of a collar 124 supported on the edge of the sleeve 106, its external diameter being substantially identical to that of the sleeve 106. The central opening of the collar 124 has a diameter which is smaller than the largest diameter of brush 115 and it is edged by a double wiper lip 125. Moreover, the collar 124 is extended on the one hand, by a cylindrical skirt 126 which is coaxial with the collar 124, the said skirt 126 being force fitted in the upper opening of the sleeve 106 until the collar 124 comes to bear on this latter and on the other hand, opposite skirt 126 by a substantially cylindrical lip 127 whose axis is identical with that of the collar 124 and whose internal diameter is slightly larger than that of the collar 124.

The support 106 consists of an elongated stem which carries at one of its ends the brush 115 and which, near its other end, is bent at right angles over a short distance and then bent again at right angles to constitute an extension carrying a rack 111 towards the inside which is identical to the rack 107.

The detachable cap 117 constituted by a lateral skirt 118 joined to a top 118*a*, is fitted on the upper opening of the sleeve 106.

In the closed position of the mascara applicator device (FIG. 8), the support 108 bears with its end carrying the rack 111 against the internal wall of the bottom 102 of the shell 101. This rack 111 meshes in its upper portion with the pinion 112 which also meshes with the bottom portion of the rack 107, the sleeve 106 being inserted solely at its lower edge zone into the shell 101. The two racks 107 and 111 are situated in the same radial plane of the device.

In the same way as in the mode of embodiment described above, the two racks 107 and 111 and the pinion 112 engage with sufficient friction for the support 108, the sleeve 106 and the shell 101 to remain immovable in relation to each other unless a sufficient axial force is exerted to modify the relative position of the sleeve 106 and of the shell 101 slidably mounted in relation of each other.

In the above mentioned closed position, the main portion of the stem of the support 108 passes through the opening 122 of the ring 121 and the brush 115 is completely retracted within the sleeve 106.

When the user wishes to use the brush 115, she takes off the cap 117 and pushes the sleeve 101 towards the opposite end of the device which is tantamount to causing the sleeve 106 to slide in the shell 101. The result is the same as in the preceding embodiment, since the brush 115 completely projects at the end of the displacement out of the sleeve 106 and its associated wiper element 123, the support 108 bearing against the ring 121 via the shoulder joining the rack 111 to the main part 108.

If reference is now made to FIG. 10, it will be seen that a lipstick case has been represented which, as a whole, is similar to that of FIG. 1. The elements of this case which are similar to those of the case of FIG. 1 have been given reference numerals exceeding those of FIG. 1 by 200. The difference between the two embodiments is due to the fact that the pinion 212 is constituted by two cog wheels 212*a*, 212*b* which are arranged on the same pin 213 which is integral with the external shell 201 and which have different diameters and hence a different number of teeth. The wheel 212*a* having the greater number of teeth cooperates with the rack 211 carried by the support 208, and the wheel 212*b* having the smaller number of teeth, cooperates with the rack 207 carried by the sleeve 206. The rack 211 must therefore extend over a greater height than that of the rack 207.

The device of FIG. 10 is, in this Figure, represented in a position where the lipstick 215 is completely retracted, the rack 211 meshing in its top position with the wheel 212*a* and the rack 207 meshing in its bottom position with the wheel 212*b*. The functioning is identical with that of the device of FIG. 1, the downward displacement of the sleeve 206 along arrow $F_1$ producing the rotation of the wheels 212*a*, 212*b* in the direction of arrow $F_2$ and consequently, the upward displacement of the support 208 along arrow $F_3$ producing the emergence of the lipstick 215 with a view to its use. However, the originality of this mode of embodiment is due to the fact that the emergence of this stick 215 is effected at a higher speed which depends on the ratio of the diameters of wheels 212*a* and 212*b*.

If reference is now made to FIG. 11, it will be seen that a lipstick case has been represented which is also similar as a whole to that of FIG. 1, its elements being marked by reference numerals exceeding those used for the similar elements of the case of FIG. 1 by 300. The difference is due to the fact that the sleeve 306 comprises two identical racks 307 disposed in the same radical plane and that the support 308, also cup shaped, which receives the lipstick 315 comprises an axial stem 328 carried externally by the bottom 310 of the above mentioned cup. In its lower portion, the stem 328 comprises two racks 311 situated in the same radical plane of the support 308. The racks 311 extend over a height substantially equal to that of the racks 307. Each facing rack pair 307, 311 cooperates with a pinion 312 capable of turning around a pin 313 mounted in the shell 301. The two pinions 312 are disposed in the same radial plane of the shell 301.

In the retracted position of stick 315, which is that represented in FIG. 11, each pinion 312 meshes on the one hand with the lower portion of the rack 307 associated therewith and on the other hand, with the upper portion of the rack 311 which is associated therewith, the stem 328 bearing in this arrangement against the bottom 302 of the shell 301 or against a stop (not shown) carried by the said bottom 302.

The functioning is based on the same princple as in the preceding embodiments. When the sleeve 306 is caused to slide downwards in the direction of arrow $F_1$ the pinions 312 each turn in an opposite direction (along the arrows $F_{2a}$ and $F_{2b}$ respectively which has the effect of causing the support 308 to rise along arrow $F_3$ to cause the lipstick 315 to emerge with a view to its use. To ensure the sliding of sleeve 306, provision is made in the latter for two pairs of slots 314, each one of the two axial ends of a pin for rotation 313 of a pinion 312 passing through one of the slots of the pair of slots 314 which is associated therewith. The fact that the number of racks and pinions has been doubled in relation to the embodiments described above ensures a better mechanical balance of the system.

It shall be duly understood that the modes of embodiment described have been given by way of an indication and not on a restrictive basis and that modifications may be introduced without thereby departing from the scope of the present invention.

We claim:

1. A case for a cosmetic applicator element comprising an external shell having a longitudinal axis and a bottom, a support mounted within said shell, said support being adapted to carry the applicator element and being displaceable in translation in said shell between a retracted position and an extended position ready for use, a first rack connected to said support and extending parallel to the axis of the shell but offset in relation to said axis, a pin fixed in relation to the external shell and substantially perpendicular to the axis of said shell, a pinion freely rotatable about said pin, the said first rack meshing with said pinion, a second rack meeting with said pinion to control its rotation, said second rack being disposed parallel to the first rack and being diametrically opposed to the latter in relation to the pin and pinion, a sleeve slidable within the external shell and integral with said second rack, said sleeve having an internal wall and an inner portion relative to said shell, said second rack being located on said internal wall and on said inner portion of said sleeve, said sleeve being coaxial with said external shell and being disposed within a portion of said external shell through which said support is displaceable, said support being disposed coaxially and slidably within said sleeve to an extent limited by said second rack, the support being slidable within the external shell and integral with said second rack, the said support being thus displaceable towards the extended position or the retracted position of the applicator element when said sleeve is displaced respectively towards the inside or the outside of the external shell, the applicator element being, in its retracted position, entirely accommodated within the sleeve and in its extended position, projecting at least partly out from said sleeve, said support having a base which is formed integrally with said first rack, said first rack extending parallel to the axis of said support towards the bottom of said external shell.

2. A case according to claim 1, which includes a detachable cap telescopically fitted on at least one of said sleeve and said shell, said cap closing the case when the support is in the retracted position of the applicator element.

3. A case according to claim 1, wherein the applicator element is a brush or a pencil brush and the support is a stem.

4. A case according to claim 1, wherein a applicator element is a stick of the cosmetic product and the support is a cup having a tubular part to accommodate a portion of the stick which is adjacent to its base.

5. A case according to claim 4, wherein the stick of cosmetic product is a lipstick.

6. A case according to claim 1, wherein the pinion is constituted by two coaxial toothed wheels placed side by side whereof one cooperates with the first rack and the other with the second, the two wheels having different numbers of teeth.

7. A case according to claim 1, wherein two said pinions are provided mounted on parallel spaced respective pins, two said second racks are provided integral with said sleeve, and two said first racks are provided integral with said support, these first and second racks constituting two pairs of first and second racks facing each other, each pair cooperating with a respective one of said pinions.

8. A case according to claim 1, wherein two longitudinal slots are arranged in opposed parts of a portion of sleeve engaged in the shell, each one of the two axial ends of the pin passing through one of said slots and being mounted to the said shell so that the cooperation between the pin and the slots ensures the axial guidance of the sleeve in its translational movement in relation to the shell.

9. A case according to claim 1, wherein the two racks and the pinion mesh with sufficient friction for these three elements and hence also the support, sleeve and the shell to remain immovable in relation to each other in any orientation of the case, if no axial force exceeding a certain threshold is exerted on said sleeve.

10. A case according to claim 1, wherein the first rack and the support on the one hand, the second rack and the sleeve on the other hand, are respectively moulded from single pieces of plastic material.

* * * * *

UNITED STATES PATENT AND TRADEMARK OFFICE

CERTIFICATE OF CORRECTION

PATENT NO. : 4,778,300

DATED : October 18, 1988

INVENTOR(S) : Bruno P. Morane et al.

It is certified that error appears in the above-identified patent and that said Letters Patent is hereby corrected as shown below:

On the title page, Item [19], "French et al." to read -- Morane et al. --.

Item [75], "Bruno P. M. French" to read

-- Bruno P. Morane --.

Signed and Sealed this

Ninth Day of May, 1989

*Attest:*

*Attesting Officer*

DONALD J. QUIGG

*Commissioner of Patents and Trademarks*